US011975909B1

(12) United States Patent
Walden

(10) Patent No.: US 11,975,909 B1
(45) Date of Patent: May 7, 2024

(54) MULTI-PURPOSE CUSHIONING SYSTEM

(71) Applicant: Daniel H. Walden, Chicago, IL (US)

(72) Inventor: Daniel H. Walden, Chicago, IL (US)

( * ) Notice: Subject to any disclaimer, the term of this patent is extended or adjusted under 35 U.S.C. 154(b) by 824 days.

(21) Appl. No.: 16/728,721

(22) Filed: Dec. 27, 2019

(51) Int. Cl.

| | |
|---|---|
| ***A47F 13/00*** | (2006.01) |
| ***A45C 7/00*** | (2006.01) |
| ***A45C 9/00*** | (2006.01) |
| ***A45F 4/02*** | (2006.01) |
| ***A47G 9/00*** | (2006.01) |
| ***B65D 81/02*** | (2006.01) |
| ***B65D 81/05*** | (2006.01) |
| ***B65D 81/36*** | (2006.01) |
| *A47G 11/00* | (2006.01) |
| *A47G 27/02* | (2006.01) |

(52) U.S. Cl.

CPC ..... *B65D 81/36* (2013.01); *A47F 13/00* (2013.01); *B65D 81/022* (2013.01); *B65D 81/051* (2013.01); *A45C 7/00* (2013.01); *A45C 7/0077* (2013.01); *A45C 9/00* (2013.01); *A45C 2009/002* (2013.01); *A45F 4/02* (2013.01); *A45F 2004/026* (2013.01); *A47G 9/00* (2013.01); *A47G 11/003* (2013.01); *A47G 27/0212* (2013.01); *Y10T 428/13* (2015.01)

(58) Field of Classification Search

CPC ..... B32B 2439/06; B32B 2439/46; A45C 2007/004

USPC ..... 383/4; 428/34.1–36.92; 297/219.1–229; 5/417, 420, 657

See application file for complete search history.

(56) References Cited

U.S. PATENT DOCUMENTS

| | | | | | |
|---|---|---|---|---|---|
| 122,672 | A | | 1/1872 | Simmons | |
| 123,095 | A | | 1/1872 | Foster | |
| 179,446 | A | | 7/1876 | Buell | |
| 224,138 | A | | 2/1880 | Brown | |
| 2,045,784 | A | | 6/1938 | Leve | |
| 3,109,474 | A | * | 11/1963 | Levi | A47C 21/022 112/475.08 |
| 3,164,187 | A | * | 1/1965 | Simmons | A45C 7/0072 150/112 |
| 3,319,273 | A | * | 5/1967 | Solin | A63B 6/00 473/29 |
| 3,670,346 | A | * | 6/1972 | Nissen | A63C 19/04 5/420 |
| 3,879,775 | A | * | 4/1975 | Iwata | A47G 9/1045 5/639 |

(Continued)

FOREIGN PATENT DOCUMENTS

| | | | |
|---|---|---|---|
| GB | 2349081 | A | 10/2000 |
| KR | 200372228 | Y1 | 1/2005 |

(Continued)

*Primary Examiner* — Michael C Romanowski

(57) ABSTRACT

A receptacle article comprises a first wall, a second wall, a connection between a peripheral edge of the first wall and the second wall, the connection defining a peripheral edge of the receptacle, a hollow interior between an inner surface of the first wall and an inner surface of the second wall, and an opening, the opening exposing the hollow interior to an external environment of the receptacle. The opening can be through a thickness of one of the first and second wall. The pocket can be filled with a filler or cushioning material so that the receptacle can function as a multi-purpose cushioning member or system. The filler material can be used plastic grocery bags.

5 Claims, 14 Drawing Sheets

(56) References Cited

U.S. PATENT DOCUMENTS 4,460,645 A * 7/1984 Jones ..... A41D 31/04 428/407
4,484,781 A * 11/1984 Phelps ..... A47C 3/16 297/452.41
4,600,091 A 7/1986 McLeod
4,606,087 A * 8/1986 Alivizatos ..... A47D 15/008 5/655
4,738,545 A 4/1988 Westgor
4,821,853 A * 4/1989 Young ..... A45C 7/0059 190/126
4,863,003 A * 9/1989 Carter ..... A45C 9/00 297/118
4,878,258 A * 11/1989 Casey ..... A47G 9/0207 428/44
4,905,990 A * 3/1990 DeSantis ..... A63B 6/00 482/148
4,987,625 A * 1/1991 Edelson ..... A47C 20/026 D12/128
5,046,860 A * 9/1991 Brennan ..... A45C 3/04 D34/1
5,066,001 A * 11/1991 Wilkinson ..... A63B 21/4037 482/52
5,163,569 A * 11/1992 Buff ..... A47F 13/085 211/195
5,219,219 A * 6/1993 Virdin, Jr. ..... A47G 11/003 206/541
5,265,292 A * 11/1993 Underell ..... A47C 4/52 5/419
5,427,246 A * 6/1995 Hadjikhani ..... A47F 13/085 206/499
5,462,785 A * 10/1995 Holland ..... E02B 15/101 428/72
5,584,422 A * 12/1996 Bond-Madsen ..... A47C 4/52 297/229
5,711,499 A * 1/1998 Sectish ..... B65F 1/06 220/495.1
5,855,412 A * 1/1999 Smith ..... B62B 3/144 297/229
6,691,356 B1 * 2/2004 Coma ..... A47G 9/062 5/722
7,131,157 B2 * 11/2006 Young ..... A47C 17/045 297/219.1
7,188,713 B1 3/2007 Espar et al.
7,320,742 B2 * 1/2008 O'Neill ..... B32B 29/08 428/137
8,578,526 B1 11/2013 Rosso
8,851,144 B2 * 10/2014 Forbis ..... E04B 1/92 160/381
9,428,931 B2 8/2016 Samaripa
9,456,672 B2 10/2016 Condon et al.
9,512,670 B2 * 12/2016 Forbis ..... E04B 1/80
2003/0077008 A1 * 4/2003 Plourde ..... B65D 33/2541 383/63
2003/0215165 A1 * 11/2003 Hogan ..... B65D 33/34 383/66
2004/0065789 A1 * 4/2004 Charbeneau ..... B60R 7/043 248/100
2006/0198561 A1 * 9/2006 Cornelisse ..... B65D 33/2583 383/66
2007/0122066 A1 * 5/2007 Landay ..... A47G 9/086 5/655
2007/0248940 A1 * 10/2007 Maguire ..... G09B 19/00 446/369
2008/0145580 A1 * 6/2008 McAllister ..... B32B 5/16 52/794.1
2008/0178391 A1 * 7/2008 Andrade ..... A47C 1/146 5/705
2009/0188181 A1 * 7/2009 Forbis ..... E04B 1/80 52/656.1
2009/0314678 A1 * 12/2009 Stein ..... A45C 15/00 206/494
2010/0252553 A1 * 10/2010 Nelson ..... A45C 13/10 220/660
2011/0176750 A1 * 7/2011 Keller ..... B65D 33/02 383/105
2012/0187015 A1 * 7/2012 Kasiwabara ..... B65D 81/03 206/484.1
2013/0116643 A1 * 5/2013 Wolrich ..... A61F 5/445 604/339
2013/0187415 A1 * 7/2013 Shelley ..... A47C 31/11 297/228.11
2014/0070575 A1 * 3/2014 von Saher ..... A47C 7/62 297/188.2
2016/0317897 A1 * 11/2016 Mariano ..... B32B 3/30
2017/0095048 A1 * 4/2017 Kohn ..... A45C 11/26
2017/0290399 A1 * 10/2017 Hollis ..... A47D 5/006
2017/0332793 A1 * 11/2017 Caluwaert ..... A47C 1/146
2018/0092473 A1 * 4/2018 Stewart ..... A47G 9/0207

FOREIGN PATENT DOCUMENTS

KR 20130027216 A 3/2013
KR 20130000304 U 9/2013
KR 200471520 Y1 2/2014

* cited by examiner

MULTI-PURPOSE CUSHIONING SYSTEM

CROSS REFERENCE

N/A

TECHNICAL FIELD

The subject matter relates to storage and organization. It further relates to a storage and organization receptacle for re-useable plastic shopping bags.

BRIEF DESCRIPTION OF DRAWINGS

Non-limiting and non-exhaustive examples of several of the various embodiments of the present subject matter are described with references to the following figures, and reference numbers refer to the same features throughout the various views and embodiments unless otherwise specified.

Figure 1:
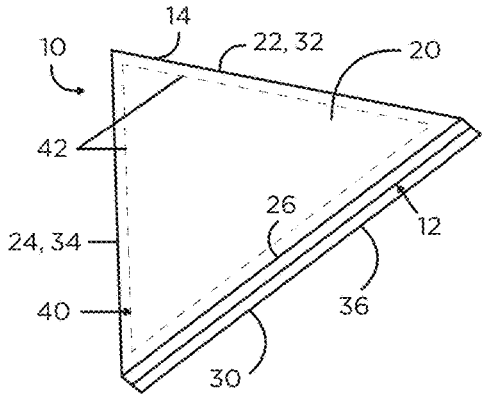
FIG. 1 illustrates a perspective view of a receptacle with a pocket in accordance with an embodiment.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. Additionally, the disclosed architecture is sufficiently configurable, such that it may be utilized in ways other than what is shown.

DETAILED DESCRIPTION

In this Specification, which includes the figures, claims, and this detailed description, reference is made to particular and possible features of the embodiments of the subject matter, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the subject matter, and in the subject matter generally. Additionally, the disclosed architecture is sufficiently configurable, such that it may be utilized in ways other than what is shown.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the subject matter in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

For purposes here, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes here, the words "comprising," "including," "having," and variants thereof, wherever they appear, shall be construed as open-ended terminology, with the same meaning as if the phrase "at least" were appended after each instance thereof.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least 1" means 1 or more.

In this specification. "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The term "couple" or "coupled" when used in this specification and appended claims refers to an indirect or direct physical third member between the identified elements, components, or objects. Often the manner of the coupling will be related specifically to the manner in which the two coupled elements interact.

The term "directly coupled" or "coupled directly," when used in this specification and appended claims, refers to a physical third member between identified elements, components, or objects, in which no other element, component, or object resides between those identified as being directly coupled.

The terms "removable", "removably coupled", "removably disposed," "readily removable", "readily detachable", "detachably coupled", "separable," "separably coupled," "releasably attached", "detachably attached", "detachably connected" and similar terms, when used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Moreover, the ordinary and customary meaning of term "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010). The term "substantially" is used in this document to accommodate minor variations that may be appropriate, for example due to a manufacturing process.

The phrase "a plurality of" followed by a feature, component, or structure is used to mean more than one, specifically including a great many, relative to the context of the component.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

The particular embodiments of the present disclosure generally provide articles and methods directed to storing and reusing plastic shopping bags.

In particular embodiments, a receptacle that has one or more pockets, the pockets are used to receive folded plastic shopping bags.

In particular embodiments, a rectangular-shaped receptacle that has a plurality of triangular-shaped pockets, the pockets are used to receive the folded plastic shopping bags.

In particular embodiments, a receptacle with inserted folded plastic shopping bags can be used as a cushioning article inside the shipping packages or as a cushioning article replacing shipping blanket or pad.

In particular embodiments, a receptacle with inserted folded plastic shopping bags can be used as a cushioning material for storing and transporting articles.

In particular embodiments, a receptacle with inserted folded plastic shopping bags can be used as a seat cushion or a picnic blanket.

In particular embodiments, a receptacle with inserted folded plastic shopping bags can be used as a flooring component.

In particular embodiments, the receptacle comprises a first member and a second member. The first and second members are being attached to each other so as to form hollow interior(s) or pocket(s). when the receptacle(s) contain cushioning materials, specifically folded plastic shopping bags, the combination is also described as a multipurpose cushioning system for brevity.

Now in a reference to FIG. 1, therein is illustrated a receptacle 10 that comprises a first member 20 and a second member 30. The first member 20 is illustrated as comprising a triangular shape. The first member 20 further comprises short edges 22 and 24 and a long edge 26, Furthermore, the first member 20 is illustrated as an isosceles right triangle with short edges 22 and 24 being substantially equal to each other. The second member 30 is also being illustrated as comprising a triangular shape. The second member 30 further comprises short edges 32 and 34 and a long edge 36. Furthermore, the second member 30 is also illustrated as an isosceles right triangle with short edges 32 and 34 being substantially equal to each other. Both the first member 20 and the second member 30 are illustrated as having substantially identical size. In other words, the first member 20 and the second member 30 are illustrated as being substantially equal to each other. Furthermore, the first member 20 can be referred to in this document as a first wall 20 and the second member 30 can be referred to in this document as a second wall 30. Receptacle can be referred to in this document as an article 10.

A material of the first and second wall, 20 and 30 respectively, can comprise any one of a nylon, a canvas, a natural leather, a synthetic leather, and a neoprene. It is not necessary that the first wall 20 and the second wall 30 are to be provided in the same material. In other words, the article 10 can comprise different materials. Furthermore, the material of the first and second wall, 20 and 30 respectively, can comprise any one of a mildew resistant material and a water proof material. Such mildew resistant material or water proof (repellent) material can be a material as presently used in shower curtains. The mildew resistant material can comprise any one of a polyester, nylon, and acrylic synthetic fabrics. The mildew resistant material can comprise a vinyl coated canvas material. In other words, one or both of the first and second wall, 20 and 30 respectively, can comprise more than one material. One or both of the first and second wall, 20 and 30 respectively, can comprise a water and mildew resistant coating. A non-limiting example of such coating can be a CANVAK® coating manufactured by Buckeye of Coshocton, OH. One or both of the first and second wall, 20 and 30 respectively, can comprise a waterproof material, for example such as Ottertex® canvas waterproof oxford fabric manufactured by Ottertex.

Figure 2:
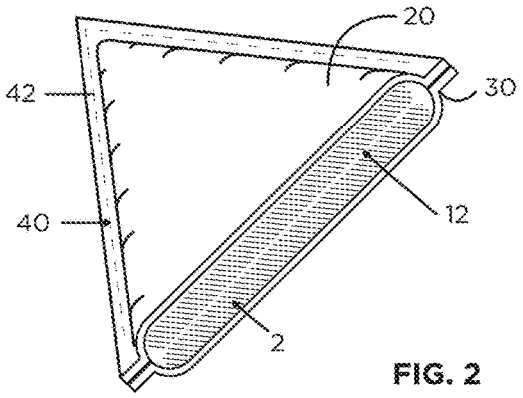
FIG. 2 illustrates a perspective view of the receptacle of FIG. 1 with pocket filled with a filler material.

Now in a reference to FIG. 2, therein is illustrated the above described receptacle 10 that further comprises a filler material 2 inserted into the pocket 12. Such filler material 2 can be any one of a plastic shopping bag, a foam peanut, and a sheet with air cushions. In an example, when the first member 20 is substantially identical to the second member 30 and when the filler material 2 is inserted into the pocket 12, the first member 20 will separate from second member 30 to define a larger thickness of the receptacle 10, than the original thickness without such filler material 2. In other words, the pocket 12 will expand due to material elasticity and may distort the original triangular shape of the receptacle 10. In an example, when the receptacle 10 is manufactured by a molding process, the pocket 12 can be sized to allow insertion of the filler material 2 without any further expansion of the first member 20 and/or the second member 30. In other words, a thickness of the receptacle 10 can be greater in the middle portion than at the peripheral edge 14. Pocket 12 can be referred to in this document as hollow interior 12. Filler material 2 can be referred to in this document as cushioning material.

The receptacle 10 also comprises an attachment means 40 for attaching the short edge 22 to the short edge 32 and attaching the short edge 24 to the short edge 34. Thus, the first member 20 and the second member 30 define a hollow interior 12 of the receptacle 10. The hollow interior 12 can also be referred to in this document as a pocket. The access to such hollow interior 12 is provided from the unattached long edges 26 and 36. Furthermore, the first member 20 and the second member 30, being attached to each other, define a peripheral edge 14 of the receptacle 10.

Figure 3:
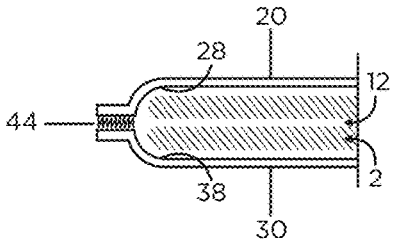
FIG. 3 illustrates a partial cross-section elevation view of the receptacle of FIGS. 1-2.
Figure 4:
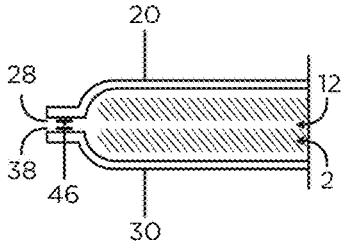
FIG. 4 illustrates a partial cross-section elevation view of the receptacle of FIGS. 1-2.

The attachment means 40 can comprise a variety of attachment components. In an example, when the first member 20 and the second member 30 are manufactured from any one of a natural leather, a synthetic leather material and a canvas material, the attachment means 40 can comprise stitches 42 of FIGS. 1-2. In an example of FIG. 3, the attachment means 40 can comprise adhesive 44. In an example, when the receptacle 10 is manufactured from a rubber material, for example such as neoprene, by a molding process, the attachment means 40 comprises an integral peripheral edge 14. In an example, when the first member 20 and the second member 30 are manufactured from a nylon material, the attachment means 40 can comprise a thermally fused connection. In an example of FIG. 4, the attachment means 40 may comprise mechanical fasteners 46 between an inner surface 28 of the first member 20 and an inner surface 38 of the second member 30. Such mechanical fasteners can comprise any one of hook and loop fastener, a snap, a button and the like fasteners.

The receptacle 10 can also comprise an attachment means 70 being disposed on or at a portion of the peripheral edge 14 so as to attach one receptacle 10 to another receptacle 10. The attachment means 70 can be disposed on or at each portion of the peripheral edge 14 so as to attach the receptacle 10 to two or three other receptacles 10. Thus, receptacles 10 can be attached to each other to form multiple patterns of receptacles 10. The attachment means 70 can be also referred to in this document as one of a connection, a detachable connection, a fastening connection and a fastener.

Figure 5:
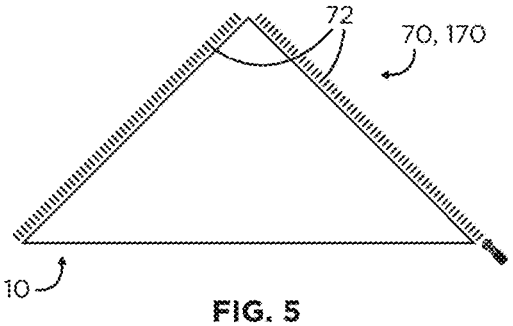
FIG. 5 illustrates a planar view of the receptacle of FIGS. 1-2 and further illustrates an example of a fastener that can connect one receptacle to another receptacle.
Figure 6:
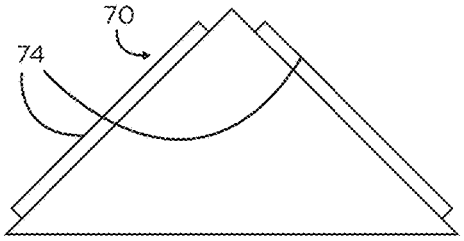
FIG. 6 illustrates a planar view of the receptacle of FIGS. 1-2 and further illustrates an example of a fastener that can connect one receptacle to another receptacle.
Figure 7:
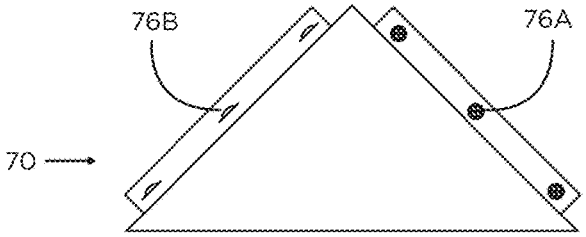
FIG. 7 illustrates a planar view of the receptacle of FIGS. 1-2 and further illustrates an example of a fastener that can connect one receptacle to another receptacle.

In an example of FIG. 5, the attachment means 70 can comprise a zipper device 72. In an example of FIG. 6, the attachment means 70 can comprise a two-part hook and loop fastener 74. In an example of FIG. 7, the attachment means 70 can comprise buttons 76A and complimentary openings 76B. In an example, the attachment means 70 can comprise an adhesive. In other words, in an example, the attachment means 70 can be configured to detachably attach the receptacle 10 to one or more other receptacles. Further, the attachment means 70 can be configured to permanently attach the receptacle 10 to one or more other receptacles, for example when using adhesive.

The receptacle 10 with the filler material 2 can be used as a packaging article to cushion and protect objects during transport. The packaging article can be further configured to reuse used plastic bags manufactured from a polyethylene material in various densities. An example of such plastic bag is a shopping bag that is commonly used to carry groceries and other small objects. This shopping bag is generally manufactured from a low-density polyethylene (LDPE), Unfortunately, such plastic shopping bags are not biodegradable and will not breakdown easily. At the present, curbside recycling programs do not accept such plastic bags as they often clog machines at recycling facilities and thus actually hinder the recycling process. Although, the grocery stores accept plastic shopping bags for specialized recycling, the recycling rates are low. As a result, many plastic shopping bags end up as plastic waste litter in the environment, when improperly disposed of. As such, these plastic bags become toxic pollutants being harmful to wildlife and generally present an environmental concern.

Thus, a method of converting used plastic shopping bags into a functioning packaging article can comprise the steps of providing a first member having a triangular shape, providing a second member having a triangular shape, forming, by attaching two short edges of the second member to two short edges of the first member, to form a triangular-shaped pocket; and inserting, through an unattached edge of the first and second members, a used plastic shopping bag into the triangular-shaped pocket.

A method of reusing used plastic shopping bags into a cushioning packaging article can comprise the steps of providing a first member having a triangular shape, providing a second member having a triangular shape, forming, by attaching two short edges of the second member to two short edges of the first member, a triangular-shaped pocket; and inserting, through an unattached edge of the first and second members, a used plastic shopping bag into the triangular-shaped pocket.

Figure 8:
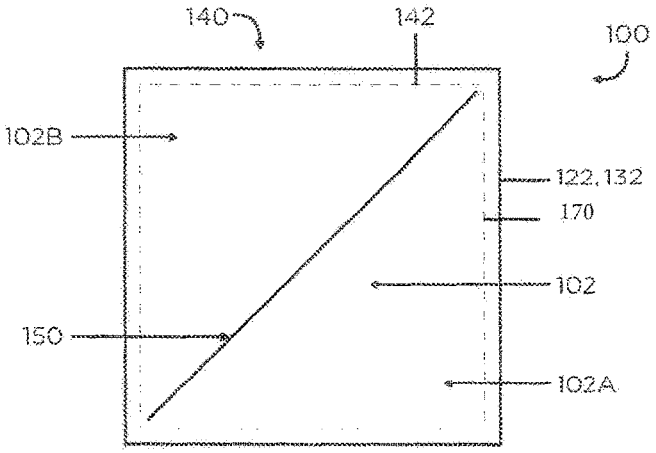
FIG. 8 illustrates a planar view of a receptacle in accordance with an embodiment.
Figure 9A:
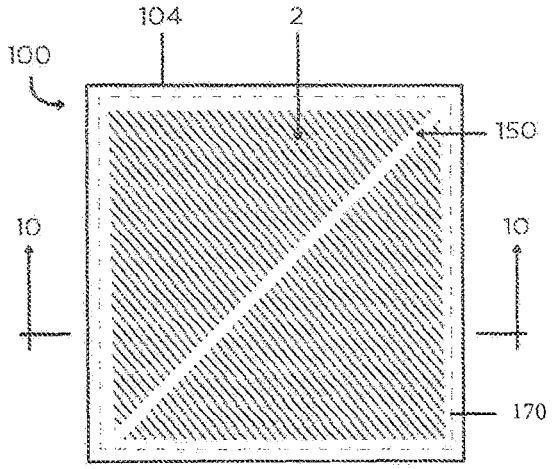
FIG. 9*a* illustrates an internal planar view of the receptacle of FIG. 8 with the pocket filled with a filler material.
Figure 9B:
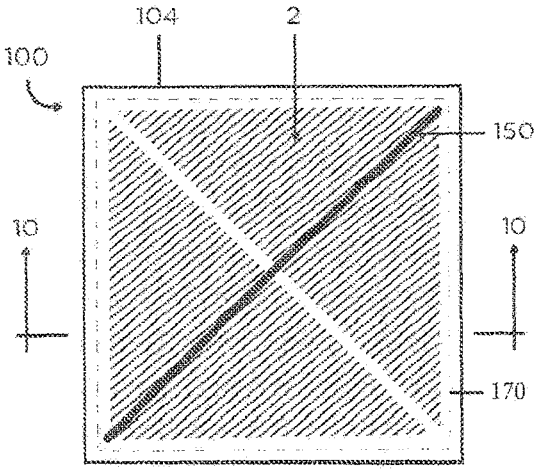
FIG. 9*b* illustrates an internal planar view of the receptacle of FIG. 8 with the pocket filled with a filler material perpendicular to the opening.
Figure 10:
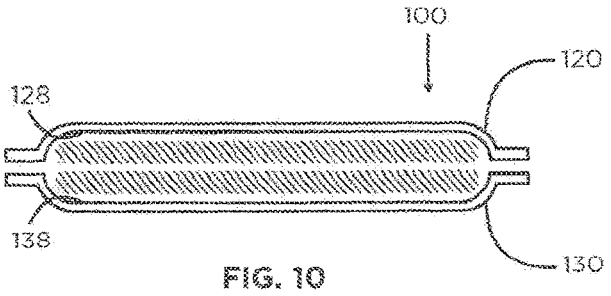
FIG. 10 illustrates a cross-section elevation view of the receptacle of FIGS. 8-9.

Now in a reference to FIGS. 8-10, therein is illustrated a receptacle 100 that comprises a first wall 120 and a second wall 130. The first wall 120 is illustrated as comprising a square shape with a peripheral edge 122. The second wall 130 is also being illustrated as comprising a square shape with a peripheral edge 132. Both the first wall 120 and the second wall 130 are illustrated as having substantially identical size. In other words, the first wall 120 and the second wall 130 are illustrated as being substantially equal to each other. Furthermore, the first wall 120 can be referred to in this document as a first member 120 and the second wall 130 can be referred to in this document as a second member 130.

A material of the first and second wall, 120 and 130 respectively, can comprise any one of a nylon, a canvas, a natural leather, a synthetic leather, and a neoprene. It is not necessary that the first wall 120 and the second wall 130 are to be provided in the same material. In other words, the article 100 can comprise different materials. Furthermore, the material of the first and second wall, 120 and 130 respectively, can comprise a mildew resistant material. Such mildew resistant material or water proof (repellent) material can be a material as presently used in shower curtains. The mildew resistant material can comprise any one of a polyester, nylon, and acrylic synthetic fabrics. The mildew resistant material can comprise a vinyl coated canvas material. In other words, one or both of the first and second wall, 120 and 130 respectively, can comprise more than one material. One or both of the first and second wall, 120 and 130 respectively, can comprise a water and mildew resistant coating. A non-limiting example of such coating can be a CANVAK® coating manufactured by Buckeye of Coshocton, OH. One or both of the first and second wall, 120 and 130 respectively, can comprise a waterproof material, for example such as Ottertex® canvas waterproof oxford fabric manufactured by Ottertex.

The receptacle 100 also comprises a connection 140 between the peripheral edge 122 of the first wall 120 and the peripheral wall 132 of the second wall. The connection 140 defines a peripheral edge 104 of the receptacle 100. The connection 140 further defines a hollow interior 102 of the receptacle 100 between an inner surface 128 of the first wall 120 and an inner surface 138 of the second wall 130.

The connection 140 can be essentially identical to the above described connection 40. The connection 140 can comprise a variety of attachment components. In an example, when the first wall 120 and the second wall 130 are manufactured from any one of a natural leather material, a synthetic leather material and a canvas material, the connection 140 can comprise the stitches 142. In an example, the connection 140 can comprise an adhesive. In an example, when the receptacle 100 is manufactured from a rubber material, for example such as neoprene, by a molding process, the connection 140 comprises an integral peripheral edge 104. In an example, when the first wall 120 and the second wall 130 are manufactured from a nylon material, the connection 140 can comprise a thermally fused connection. In an example, the connection 140 may comprise mechanical fasteners between an inner surface 128 of the first wall 120 and an inner surface 138 of the second wall 130. The connection 140 can be further referred to as attachment means.

The receptacle 100 also comprises an opening 150 through a thickness of one of the first wall 120 and the second wall 130. In FIG. 8, such one wall is illustrated as the first wall 120. The opening 150 exposes the hollow interior 102 to an external environment of the receptacle 100. The opening 150 comprises an elongated slot. The elongated slot is being aligned in a direction between two diagonally opposite corners of the receptacle 100. Thus, the opening 150 divides the hollow interior 102 into two isosceles right triangular portions 102A and 102B. It is clear from FIGS. 9*a* and 9*b*, as it would be to a person of skill in the art, that the folded plastic bags could be inserted into the receptacle in a particular right triangle portion or also oriented perpendicularly to cross under the elongated slot. This is the case for the variously-shaped embodiments: that the folded plastic bags may be placed to fill the hollow pocket of a receptacle in such a way as to cross or bridge under the access opening, as seen in FIG. 9*b*.

However, the receptacle 100 can be configured as a rectangle, where the opening 150 defines two right triangular portions. The receptacle 100 can be configured as an isosceles triangle, where the opening will be aligned along a height of such isosceles triangle to divide it in two right triangular portions. Thus, the shape of the receptacle 100 is not a limiting factor in this document.

The receptacle 100 can also comprise an attachment means 170 being disposed on or at a portion of the peripheral edge 104 so as to detachably attach one receptacle 100 to another receptacle 100. The attachment means 170 can be disposed on or at each portion of the peripheral edge 104 so as to detachably attach the receptacle 100 to two or three other receptacles 100. Thus, receptacles 100 can be detachably attached to each other to form multiple patterns of receptacles 100. The attachment means 170 can be also referred to in this document as one of a connection, a detachable connection and a fastening connection. For the sake of brevity, the attachment means 170 can be any one of the above described attachment means 70.

Figure 11:
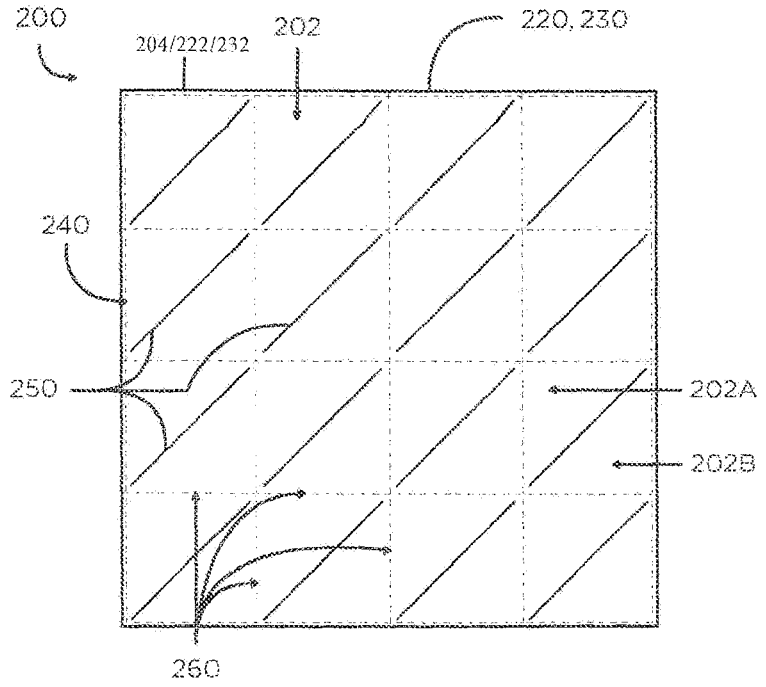
FIG. 11 illustrates a planar view of a receptacle in accordance with an embodiment.

Now in a reference to FIG. 11, therein is illustrated a receptacle 200 that comprises a first wall 220, a second wall 230, a first connection 240, openings 250 and a second connection 260.

The first wall 220 is illustrated as comprising a quadrilateral shape with a peripheral edge 222. The second wall 230 is also being illustrated as comprising a quadrilateral shape with a peripheral edge 232. Both the first wall 220 and the second wall 230 are illustrated as having substantially identical size. In other words, the first wall 220 and the second wall 230 are illustrated as being substantially equal to each other. Furthermore, the first wall 220 can be referred to in this document as a first member 220 and the second wall 230 can be referred to in this document as a second member 230. The first connection 200 is between a peripheral edge of the first wall 220 and the second wall 230. The first connection 240 defines a rectangular peripheral edge of the receptacle 200. The second connection 260 defines an orthogonal grid of second connections 260 between the first and second walls. 220 and 230 respectively. The orthogonal grid of second connections 260 defines a plurality of square pockets (hollow interior) 202 within the peripheral edge 204 of the receptacle 200. The opening 250 comprises an orthogonal grid of elongated openings 250 through a thickness of one of the first wall 220 and the second wall 230. In other words, the elongated opening 250 can be provided through a thickness of the first wall 220 or through a thickness of the second wall 230 or even through thicknesses of both the first wall 220 and the second wall 230. Each elongated opening 250 is positioned within each pocket 202 so as to expose a hollow interior of each pocket 202 to an external environment of the receptacle 200. A length of each elongated opening 250 being aligned with a pair of diagonally opposite corners of each pocket 202 to divide each pocket 202 into two triangular portions 202A and 202B. The receptacle 200 is configured to bend at the second connections 260. In an example, the elongated opening 250 can be a simple slit through the thickness of the first wall 220. In other words, the width of the slit is essentially non-existent by being the same as the width of a blade or a knife making such slit. In this example, the long edges of the two triangular portions 202A and 202B will be positioned in a close proximity to each other and may even touch. The long edges may separate during use of the receptacle 200 when the filler material 2 is inserted into one or both triangular portions 202A and 202B. In an example, the elongated opening 250 can be made wider and can be clearly visible in each pocket 202 so as to ease insertion of the filler material 2 into one or both triangular portions 202A and 202B.

A material of the first and second wall, 220 and 230 respectively, can comprise any one of a nylon, a canvas, a natural leather, a synthetic leather, and a neoprene. It is not necessary that the first wall 220 and the second wall 230 are to be provided in the same material. In other words, the article 200 can comprise different materials. Furthermore, the material of the first and second wall, 220 and 230 respectively, can comprise a mildew resistant material.

The first connection 240 can be any one of the above described connections 40, 140.

The second connection 260 also can be any one of the above described connections 40, 140, In other words, the second connection 260 can be provided in a variety of different connections. In an example, the second connection 260 can comprise stitches. In an example, the second connection 260 can comprise adhesive. In an example, when the receptacle 200 is manufactured from a rubber material, for example such as neoprene, by a molding process, the second connection 260 comprises integral portions of the first wall 220 and the second wall 230. In an example, when the first member 220 and the second member 230 are manufactured from a nylon material, the second connection 260 can comprise a thermally fused connection. In an example, the second connection 260 may comprise mechanical fasteners between an inner surface of the first member 220 and an inner surface of the second member 230.

The receptacle 200 can further comprise a first fastener 270 attached to one portion of the peripheral edge 204 of the receptacle 200 and a second fastener 280 attached to an opposite portion of the peripheral edge 204 of the receptacle 200.

Figure 12:
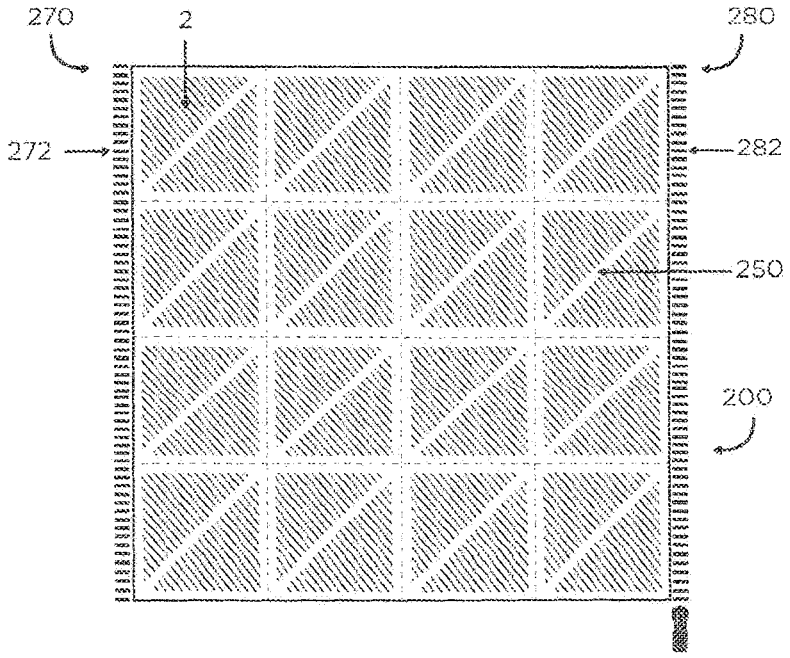
FIG. 12 illustrates a planar view of the receptacle of FIG. 11 with the pocket being filled with a filler material to create a multi-purpose cushioning system, and an example of a fastener.
Figure 13:
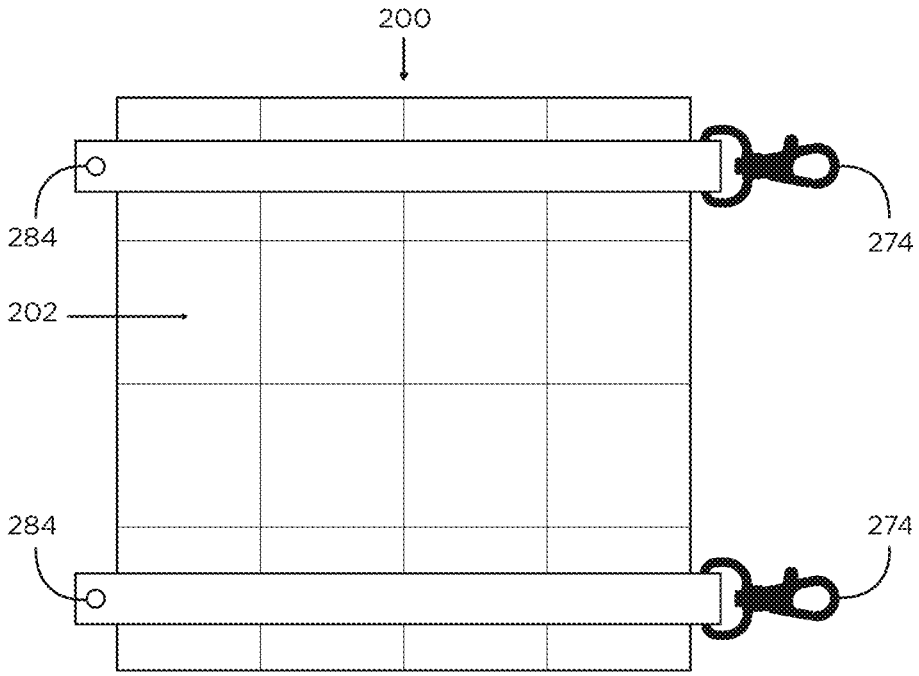
FIG. 13 illustrates an example of a fastener that can connect one receptacle of FIGS. 11-12 to another receptacle, where the fastener is on the opposite side of the pocket openings.
Figure 14:
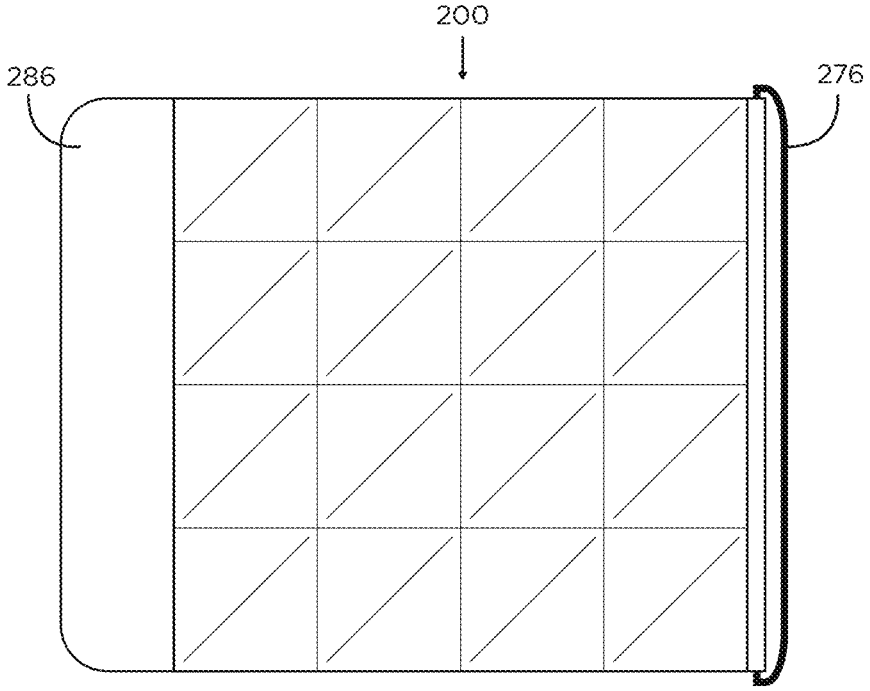
FIG. 14 illustrates an example of a fastener that can connect one receptacle of FIGS. 11-12 to another receptacle.
Figure 15:
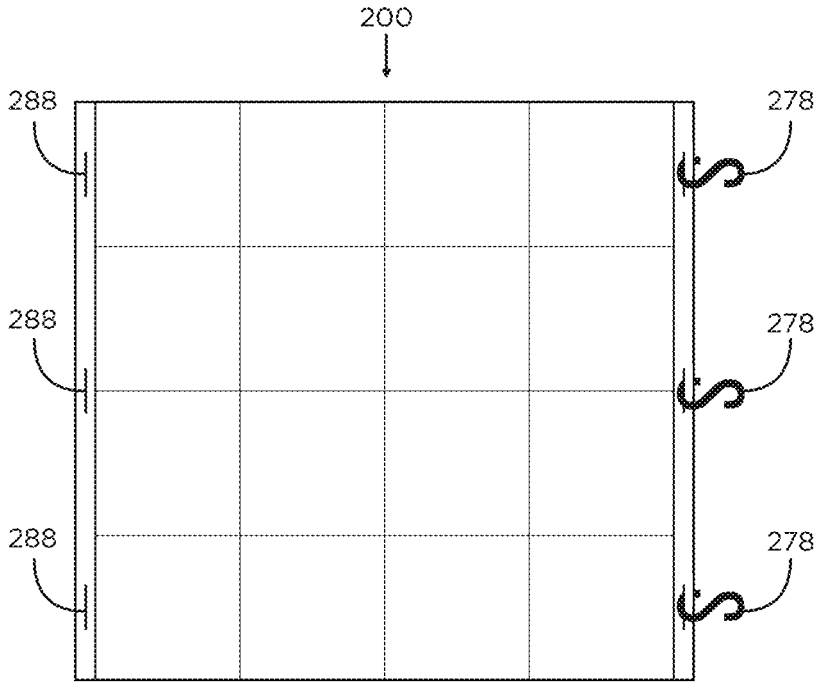
FIG. 15 illustrates an example of a fastener that can connect one receptacle of FIGS. 11-12 to another receptacle.
Figure 16:
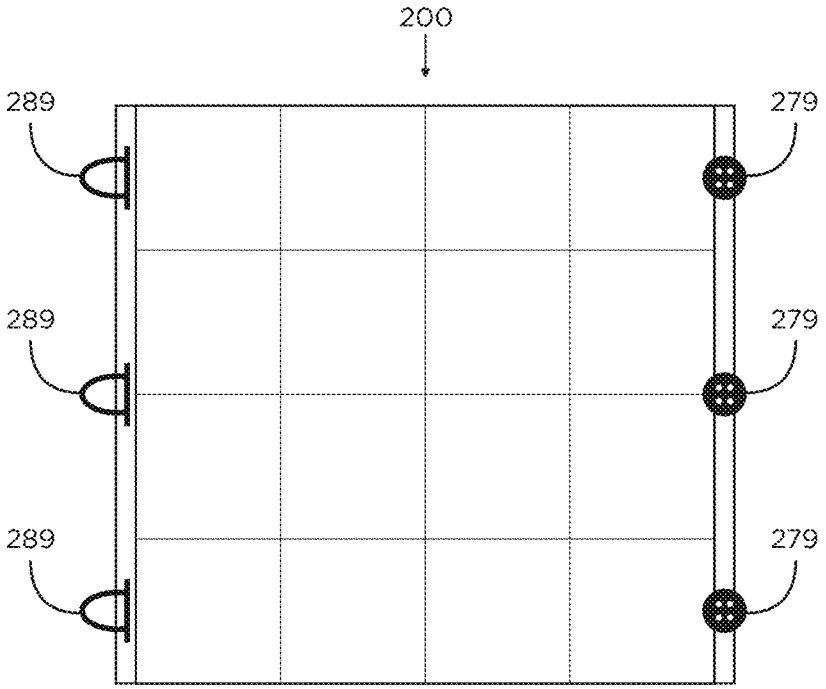
FIG. 16 illustrates an example of a fastener that can connect one receptacle of FIGS. 11-12 to another receptacle.

In an example of FIG. 12, such first fastener can comprise a first part 272 of a zipper and a second fastener can comprise a second part 282 of a zipper. In an example of FIG. 13, such first fastener can comprise a carabiner 274 and a second fastener can comprise an opening 284. In an example of FIG. 14, such first fastener can comprise a first part 276 of a hook and loop fastener and a second fastener can comprise a second part 286 of a hook and loop fastener. In an example of FIG. 15, such first fastener can comprise a hook 278 and a second fastener can comprise a hook-hole 288, being sized to receive such hook 278. In an example of FIG. 16, such first fastener can comprise a button 279 and a second fastener can comprise a buttonhole 289, being sized to receive such button 279.

The receptacle 200 provides a multi-purpose cushioning system when one or more pockets 202 are filled with a cushioning material 2, The cushioning material 2 can comprise at least one of a plastic shopping bag, a foam peanut, and a sheet with air cushions.

In an embodiment, the cushioning material 2 comprises plastic shopping bags, each plastic shopping bag being folded into a triangular shape prior to insertion into a respective pocket 202A, 202B, the triangular shape of each shopping bag being substantially equal to a triangular shape of the respective pocket 202A, 202B.

In the above described receptacle 200, one wall, for example such as the first wall 220, can be provided as a plurality of triangular-shaped sheets of material that are attached to the second wall 230 to define pockets 200 and the elongated opening 250. Thus, in an embodiment, a receptacle comprises a quadrilaterally-shaped sheet of material, the quadrilaterally-shaped sheet of material defining a continuous wall of the receptacle; a plurality of triangular-shaped sheets of material; first connections between edges of some triangular-shaped sheets of material with a peripheral edge of the quadrilaterally-shaped sheet of material, the connection defining a peripheral edge of the receptacle; second connections between edges of some triangular-shaped sheets of material with the quadrilaterally-shaped sheet of material mediate the peripheral edge of the receptacle; and the first and second connections defining triangular-shaped pockets and openings between opposing unconnected edges of a pair of adjacent pockets. Each opening is configured to selectively allow insertion of object (s) into each pocket and a removal of the object(s) therefrom.

Similarly, the receptacle 100 can comprise one wall, for example such as the first wall 120, that is provided as a pair of triangular walls.

As it has been explained above, plastic shopping bags can be harmful to wildlife. Thus, some individuals may decide on storing the plastic shopping bags after carrying the groceries or other objects rather than throwing them out or recycling. Therefore, the receptacle, particularly a multi-pocket storage receptacle 200, can be used as a storage receptacle.

Thus, in an embodiment a storage receptacle comprises a quadrilaterally-shaped sheet of material, the sheet of material defining a continuous wall of the receptacle; a plurality of triangular-shaped sheets of material; first connections between edges of some triangular-shaped sheets of material with a peripheral edge of the quadrilaterally-shaped sheet of material, the connection defining a peripheral edge of the receptacle; second connections between edges of some triangular-shaped sheets of material with the quadrilaterally-shaped sheet of material mediate the peripheral edge of the receptacle; and the first and second connections defining triangular-shaped storage pockets and opening between opposing unconnected edges of a pair of adjacent storage pockets, the opening is configured to selectively allow insertion of object(s) into each storage pocket and a removal of the object(s) therefrom.

In an embodiment a storage receptacle comprises a first quadrilaterally-shaped sheet of material, the first quadrilaterally-shaped sheet of material defining a first continuous wall of the receptacle; a second quadrilaterally-shaped sheet of material, the first quadrilaterally-shaped sheet of material defining a second continuous wall of the receptacle; first connections between a peripheral edge of the first continuous wall and a peripheral edge of the second continuous wall, the connection defining a peripheral edge of the receptacle; second connections between inner surfaces of the first and second walls mediate the peripheral edge of the receptacle, the second connections defining square storage pockets of the receptacle; elongated openings in one of the first and second continuous wall, each elongated opening is positioning within a respective square pocket to divide such respective square storage pocket into two triangular storage pocket portions; each elongated opening is configured to selectively allow insertion of object(s) into each triangular storage pocket and a removal of the object(s) therefrom.

Accordingly, a method of recycling used plastic shopping bags can comprise the steps of providing a receptacle, the receptacle comprising a first wall having a quadrilateral shape, a second wall having the quadrilateral shape, a first connection between a peripheral edge of the first wall and the second wall, the first connection defining a quadrilaterally-shaped peripheral edge of the receptacle, an orthogonal grid of second connections between the first and second walls, the orthogonal grids of second connections defining a plurality of square pockets within the peripheral edge of the receptacle, and an orthogonal grid of elongated openings through a thickness of one of the first wall and the second wall, each elongated opening is positioned within each square pocket so as to expose a hollow interior of each square pocket to an external environment of the multi-purpose cushioning system, a length of each elongated opening being aligned with a pair of diagonally opposite corners of each square pocket to divide each pocket into two triangular portions; and inserting used plastic shopping bag(s) into each triangular portion. The elongated opening can be also aligned parallel to two opposite edges of any one square pocket to receive a plastic bag folded into a square. When the used plastic shopping bag is at least one of soiled and contaminated, the method can further comprise a step of washing the used plastic shopping bag prior to inserting the used plastic shopping bag into each triangular portion. The method can also comprise an optional step of grading the washed used plastic shopping bag based on a degree of contamination or soilage remaining on the used plastic shopping bag or a degree of intactness of the used plastic shopping bag. The method can comprise inserting wet used plastic shopping bag or the method can comprise a step of drying the washed used plastic shopping bag prior to inserting the used plastic shopping bag into each triangular portion. The method can comprise stuffing the used plastic shopping bag into each triangular portion. Or, the method can comprise a step of folding the used plastic shopping bag into a triangular shape prior to inserting the used plastic shopping bag into each triangular portion. It will be understood that the method can also comprise a step of collecting the used plastic shopping bags. The above described method can be used with any plastic bags.

Figure 17:
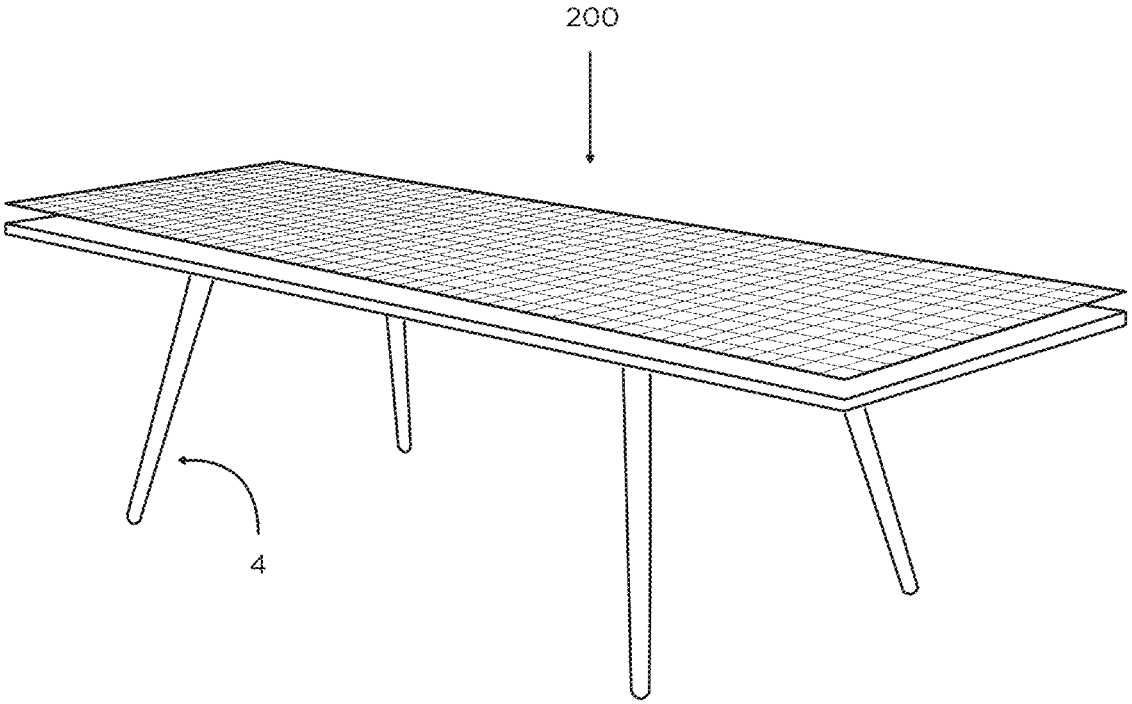
FIG. 17 illustrates use of the receptacle as a surface protection component.

In a reference to FIG. 17, the receptacle, particularly such as the receptacle 200, with the filler material 2 can be used to protect a surface of a table 4. In this application, the receptacle will be placed on top of an upper surface of the table 4 and cushion an impact of any objects placed or dropped onto such surface. The receptacle can further protect the surface from any unintentional liquid spillage. The cushioned receptacle can even provide a safe working surface on the table 4. It would be understood that other surfaces, ether flat or curved can be protected with the above described receptacle 200, that allows bending along the second connections 260.

Thus, in an embodiment, a method of protecting a surface comprises steps of providing a receptacle, the receptacle comprising a first wall having a quadrilateral shape, a second wall having the quadrilateral shape, a first connection between a peripheral edge of the first wall and the second wall, the first connection defining a quadrilaterally-shaped peripheral edge of the receptacle, an orthogonal grid of second connections between the first and second walls, the orthogonal grids of second connections defining a plurality of square pockets within the peripheral edge of the receptacle, and an orthogonal grid of elongated openings through a thickness of one of the first wall and the second wall, each elongated opening is positioned within each pocket so as to expose a hollow interior of each square pocket to an external environment of the multi-purpose cushioning system, a length of each elongated opening being aligned with a pair of diagonally opposite corners of each square pocket to divide each pocket into two triangular portions; inserting a filler material, for example such as used plastic shopping bags into each triangular portion; and positioning the receptacle with the filler material on the surface. The elongated opening can be also aligned parallel to two opposite edges of any one square pocket to receive a plastic bag folded into a square.

Figure 18:
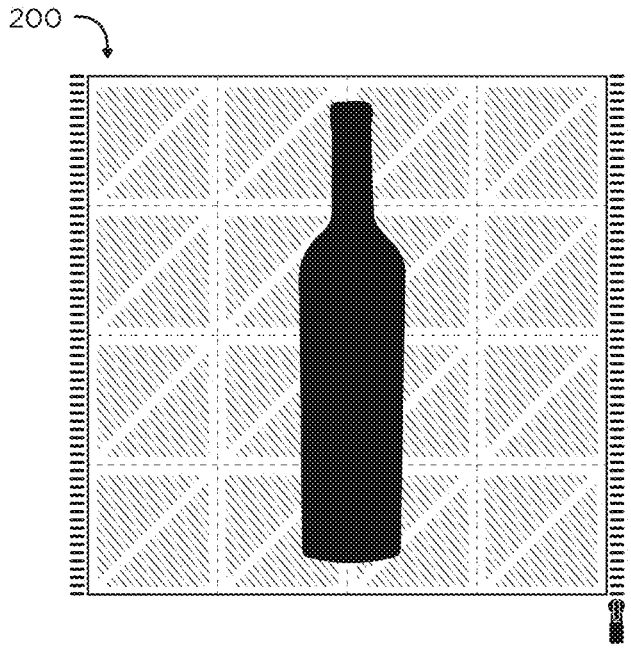
FIG. 18 illustrates one environmental use of the receptacle.
Figures 19, 20:
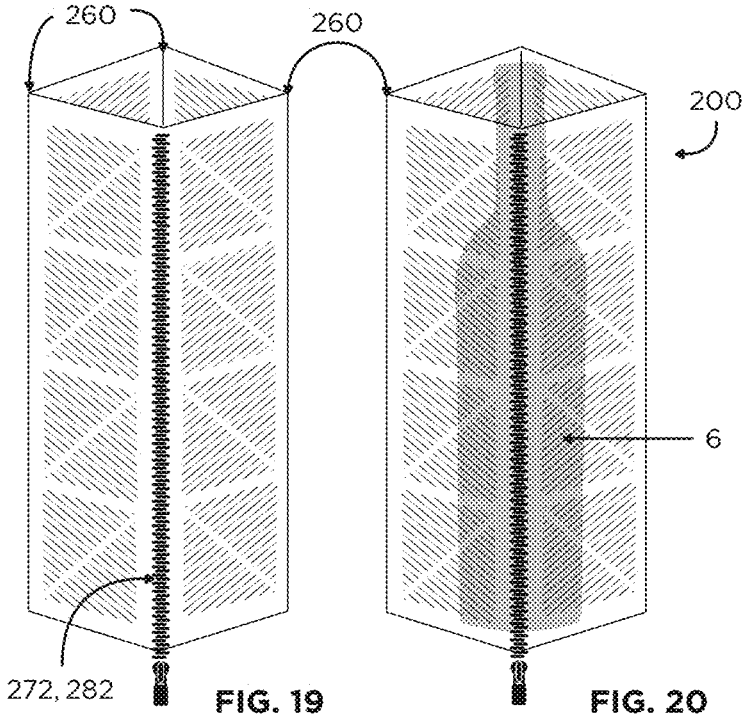
FIG. 19 illustrates the receptacle of FIG. 18 in a folded condition.
FIG. 20 illustrates the receptacle of FIG. 18 in a folded condition for use as a packaging component.

Now, in a reference to FIGS. 18-20, therein is illustrated a receptacle 200 that is used to protect an object 6 during one of storage and transport. The object 6 is illustrated as a bottle, Such bottle can be a wine bottle. The receptacle 200 is being further illustrated as comprising three second connections 260 that allow the receptacle 200 to be formed into a hollow tubular member and wrap around the periphery of the wine bottle. In an example, the free opposite edges of the receptacle 200 can be allowed to be left unattached to each other. In an example, the free opposite edges of the receptacle 200 can be connected together with fasteners 272 and 282, The filler material is being illustrated as the above described used plastic shopping bags, but can be any filler material.

Thus, in an embodiment, a method of protecting an object comprises the steps of providing a receptacle, the receptacle comprising a first wall having a quadrilateral shape, a second wall having the quadrilateral shape, a first connection between a peripheral edge of the first wall and the second wall, the first connection defining a quadrilaterally-shaped peripheral edge of the receptacle, an orthogonal grid of second connections between the first and second walls, the orthogonal grids of second connections defining a plurality of square pockets within the peripheral edge of the receptacle, and an orthogonal grid of elongated openings through a thickness of one of the first wall and the second wall, each elongated opening is positioned within each pocket so as to expose a hollow interior of each pocket to an external environment of the multi-purpose cushioning system, a length of each elongated opening being aligned with a pair of diagonally opposite corners of each pocket to divide each pocket into two triangular portions; inserting a used plastic shopping bag into each triangular portion; and wrapping the receptacle with the used plastic shopping bags around the object, while bending the receptacle along the second connections. The method can further comprise a step of detachably securing abutting edge portions of the substrate after wrapping the receptacle with the used plastic shopping bags around the object. The step of detachably securing opposite edge portions of the receptacle can comprise a step of attaching a first fastener to one portion of the peripheral edge of the receptacle, a step of attaching a second fastener to an opposite portion of the peripheral edge of the receptacle and a step of interlocking the first fastener with the second fastener. The elongated opening can be also aligned parallel to two opposite edges of any one square pocket to receive a plastic bag folded into a square.

Figure 21:
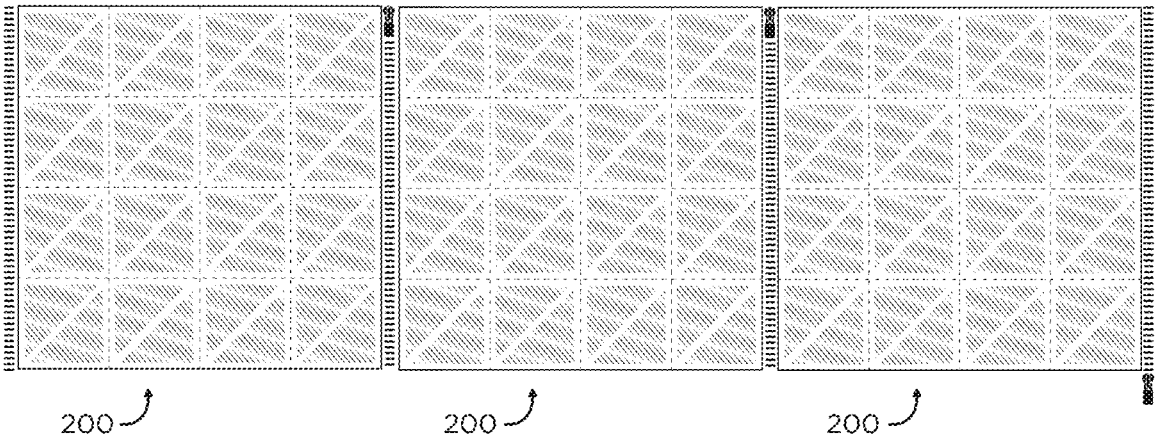
FIG. 21 illustrates a system of multiple receptacles of FIGS. 11-12.

FIG. 21 illustrates a plurality of receptacles 200 joined therebetween with a zipper fastener into a system of receptacles 200. It is to be understood that such zipper fasteners can be also provided on the remaining edge portions of at least some receptacle 200, allowing each receptacle 200 to be attached to four other receptacles 200 into a system of receptacles 200.

Figure 22:
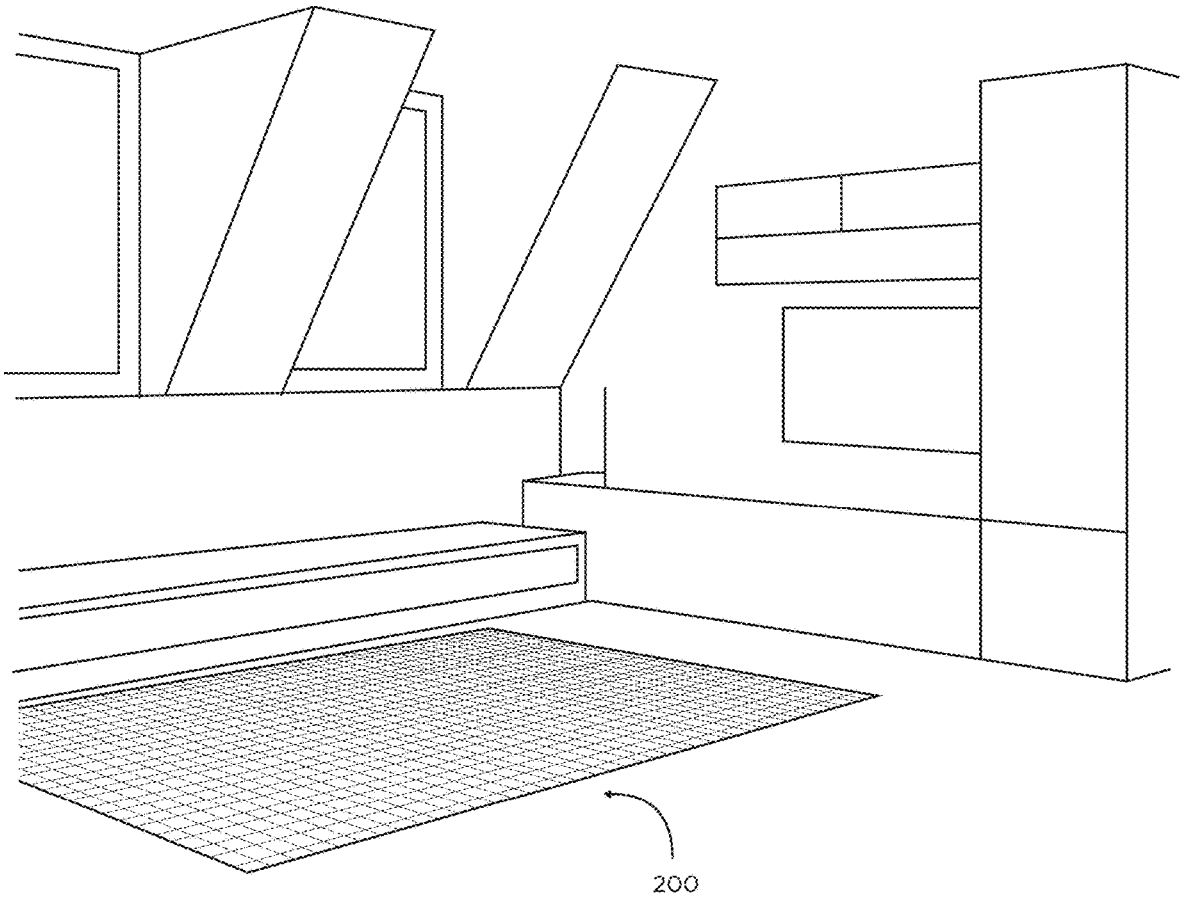
FIG. 22 illustrates use of the receptacle as a flooring component.

Now in a reference to FIG. 22, the receptacle 200 is illustrated as a flooring component or a system. Such flooring system can comprise a plurality of receptacles, each receptacle from the plurality of receptacles comprising a first wall having a quadrilateral shape, a second wall having the quadrilateral shape, a first connection between a peripheral edge of the first wall and the second wall, the first connection defining a quadrilaterally-shaped peripheral edge of the receptacle, an orthogonal grid of second connections between the first and second walls, the orthogonal grids of second connections defining a plurality of square pockets within the peripheral edge of the receptacle, an orthogonal grid of elongated openings through a thickness of one of the first wall and the second wall, each elongated opening is positioned within each square pocket so as to expose a hollow interior of each square pocket to an external environment of the multi-purpose cushioning system, a length of each elongated opening being aligned with a pair of diagonally opposite corners of each pocket to divide each pocket into two triangular portions, a first fastener attached to one portion of the peripheral edge of the receptacle, and a second fastener attached to an opposite portion of the peripheral edge of the receptacle; and a plurality of plastic shopping bags, each plastic shopping bag from the plurality of plastic shopping bags being folded into a triangular shape, one or more plastic shopping bags from the plurality of plastic shopping bags being inserted into each triangular portion; the plurality of receptacles being detachably connected therebetween with the first and second fasteners. The elongated opening can be also aligned parallel to two opposite edges of any one square pocket to receive a plastic bag folded into a square.

It would be understood from the above that the subject matter can provide a method of converting used plastic shopping bags into a functional article. The method comprising the steps of providing a first member having a quadrilateral shape; providing two second members, each second member from the two second member having a triangular shape; forming, by attaching two short edges of one second member to two adjacent edges of the first member, a first triangular pocket; forming, by attaching two short edges of another second member to two remaining adjacent edges of the first member, a second triangular pocket; and inserting, through an unattached edge of each second member, a used plastic shopping bag into each of the first and second triangular pocket.

Thus, it would be understood from the above described embodiments and examples, that the receptacle, 10, 100, 200 provide a multi-function receptacle that can be used for at least one of cushioning, storage, environment conservation and the like tasks.

Figure 23:
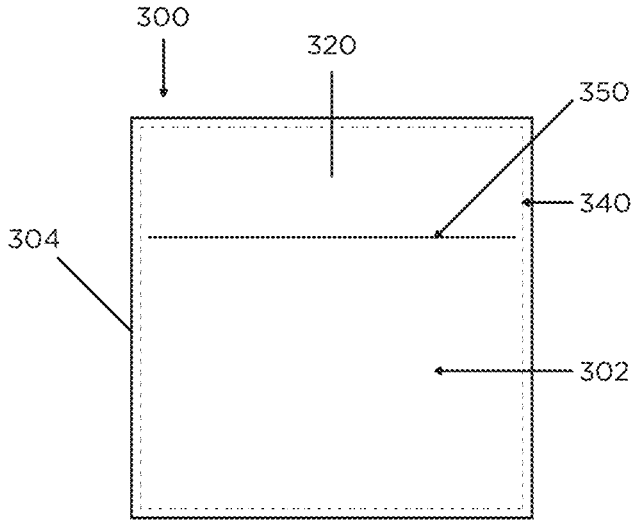
FIG. 23 illustrates a planar view of a receptacle in accordance with an embodiment.

Now in a reference to FIG. 23, therein is illustrated a receptacle 300. The receptacle 300 comprises a first member 320, a second member (not shown but is being essentially identical to the above described first member 320), and the connection 340 between the first member 320 and the second member (not shown). The receptacle 300 defines a hollow interior 302 and a peripheral edge 304. The receptacle 300 is being constructed essentially identical to the above described receptacle 100 and the detail description is being omitted herein for the sake of brevity. The difference between the receptacle 300 and the receptacle 100 is that the elongated opening 350 in the receptacle 300 is disposed substantially parallel to a pair of opposite edges of the receptacle 300. When the filler material is plastic shopping (grocery) bag, such bag can be folded into a square rather than a triangle, prior to insertion into the pocket 302 through the elongated opening 350. The receptacle 300 can be used in the same applications as the above described receptacle 100. The receptacle 300 can be adapted with a means for attaching one receptacle 300 to one or more other receptacles 300. Such means can be identical to the above described attachment means 170, 270.

Figure 24:
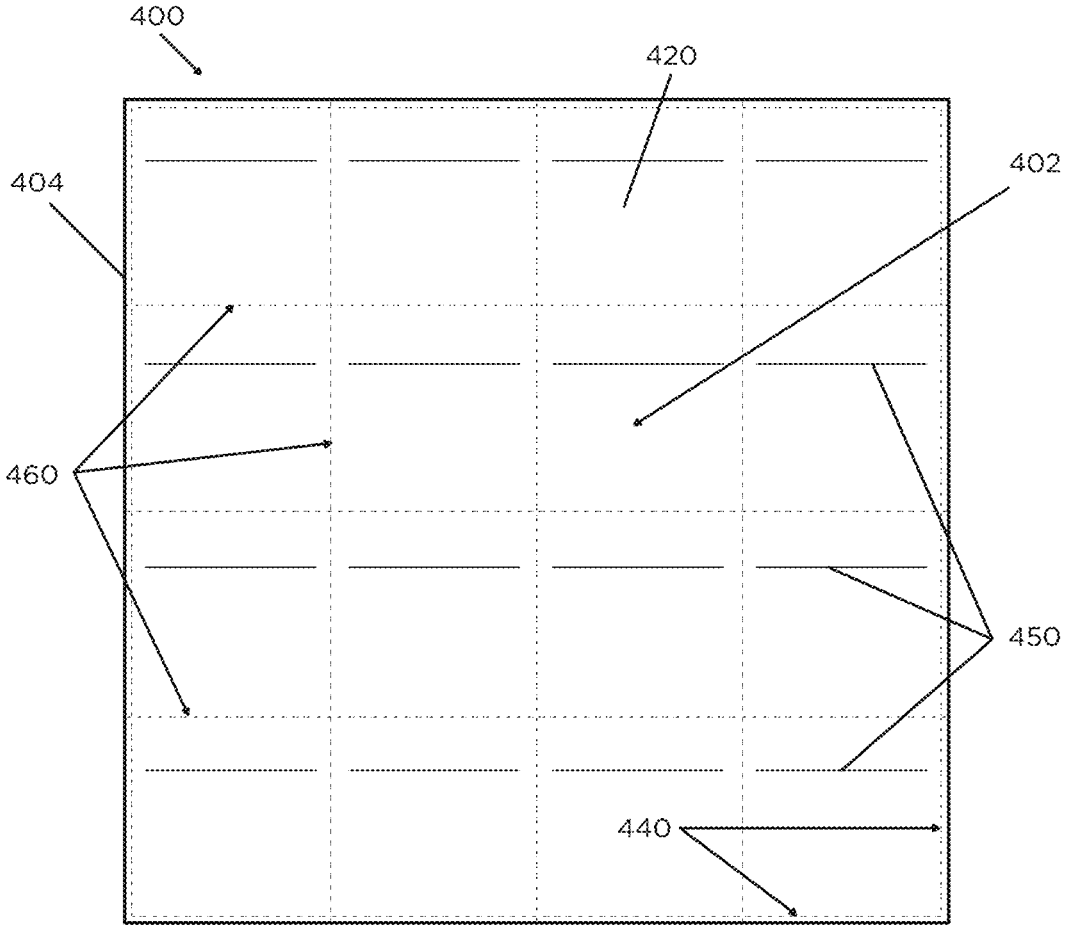
FIG. 24 illustrates a planar view of a receptacle in accordance with an embodiment.

Now in a reference to FIG. 24, therein is illustrated a receptacle 400. The receptacle 400 comprises a first member 420, a second member (not shown but is being essentially identical to the above described first member 420, and the connection 440 between the first member 420 and the second member (not shown). The receptacle 400 defines a hollow interior 402 and a peripheral edge 404. The receptacle 400 is being constructed essentially identical to the above described receptacle 200 and the detail description is being omitted herein for the sake of brevity. The difference between receptacle 400 and the receptacle 200 is that the elongated openings 450 in the receptacle 400 are disposed substantially parallel to a pair of opposite edges of each square pocket 402. When the filler material is plastic shopping (grocery) bag, such bag can be folded into a square rather than a triangle, prior to insertion into the pocket 402 through the elongated opening 450. The receptacle 400 can be used in the same applications as the above described receptacle 200. The receptacle 400 can be adapted with a means for attaching one receptacle 400 to one or more other receptacles 400 or attaching the opposite edges of the receptacle 400 to each other. Such means can be identical to the above described means 170.

It would be also understood from the above described subject matter that the receptacle 300, 400 can be provided in a rectangular shape to receive a plastic shopping (grocery) bag folded into a rectangle.

Figure 25:
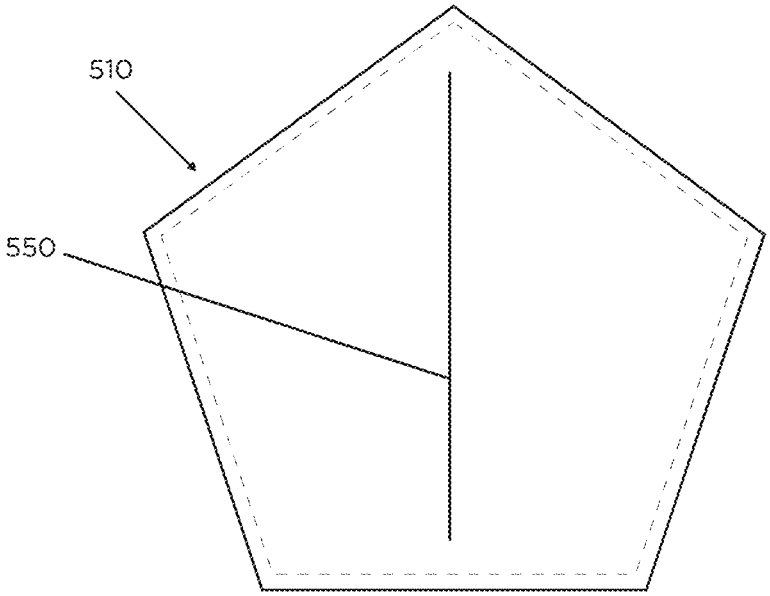
FIG. 25 illustrates a planar view of a receptacle in accordance with an embodiment.
Figure 26:
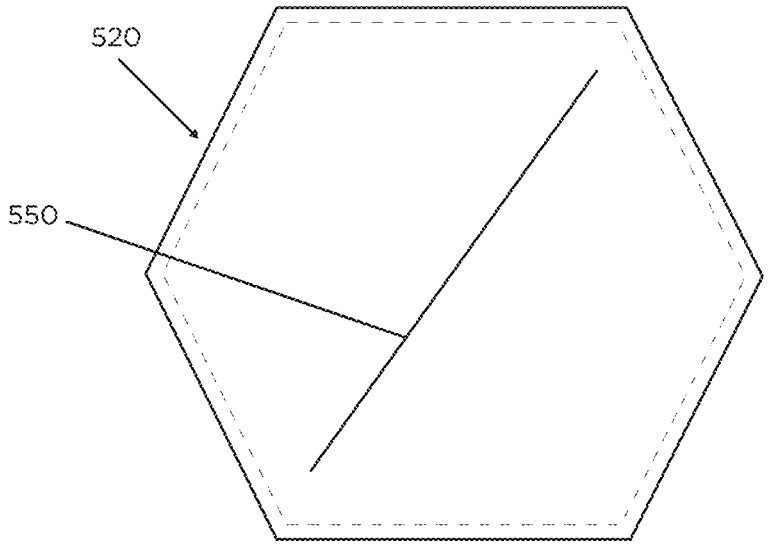
FIG. 26 illustrates a planar view of a receptacle in accordance with an embodiment.
Figure 27:
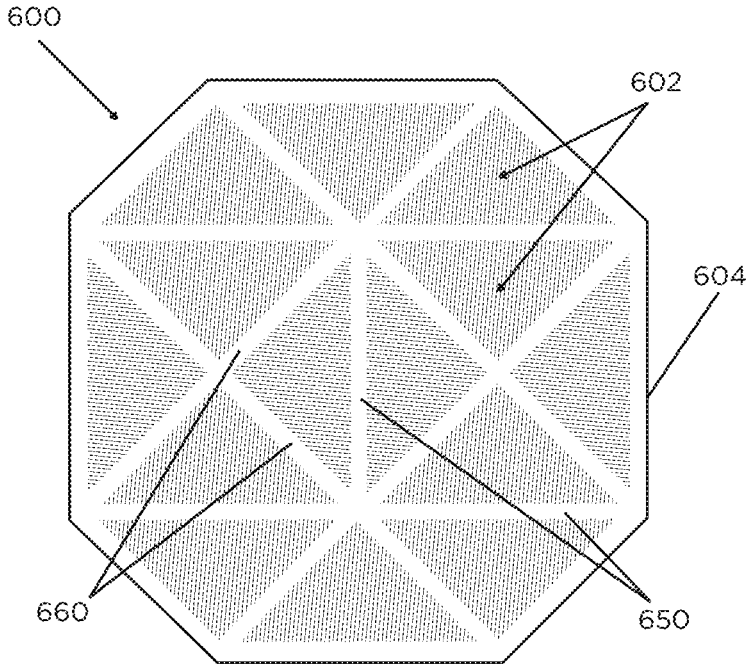
FIG. 27 illustrates a planar view of a receptacle in accordance with an embodiment.
Figure 28:
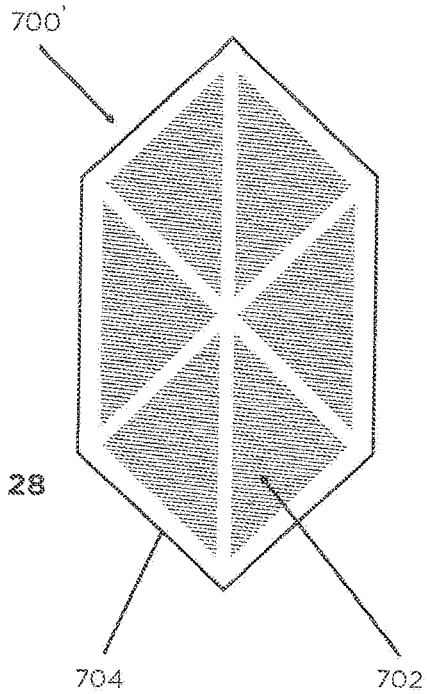
FIG. 28 illustrates a planar view of a receptacle in accordance with an embodiment.
Figure 29:
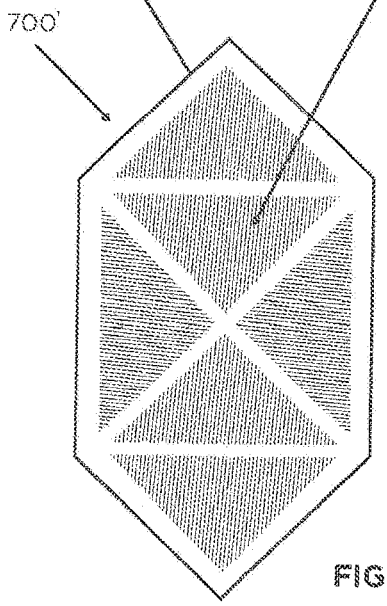
FIG. 29 illustrates a planar view of a receptacle in accordance with an embodiment.
Figure 30:
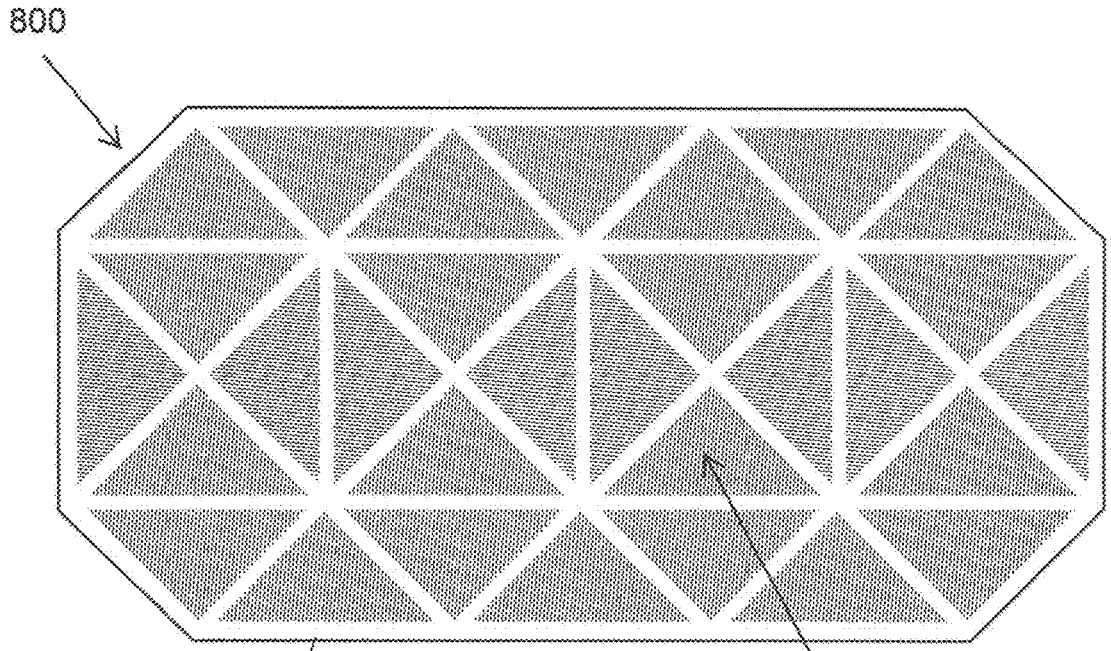
FIG. 30 illustrates a planar view of a receptacle in accordance with an embodiment.
Figure 31:
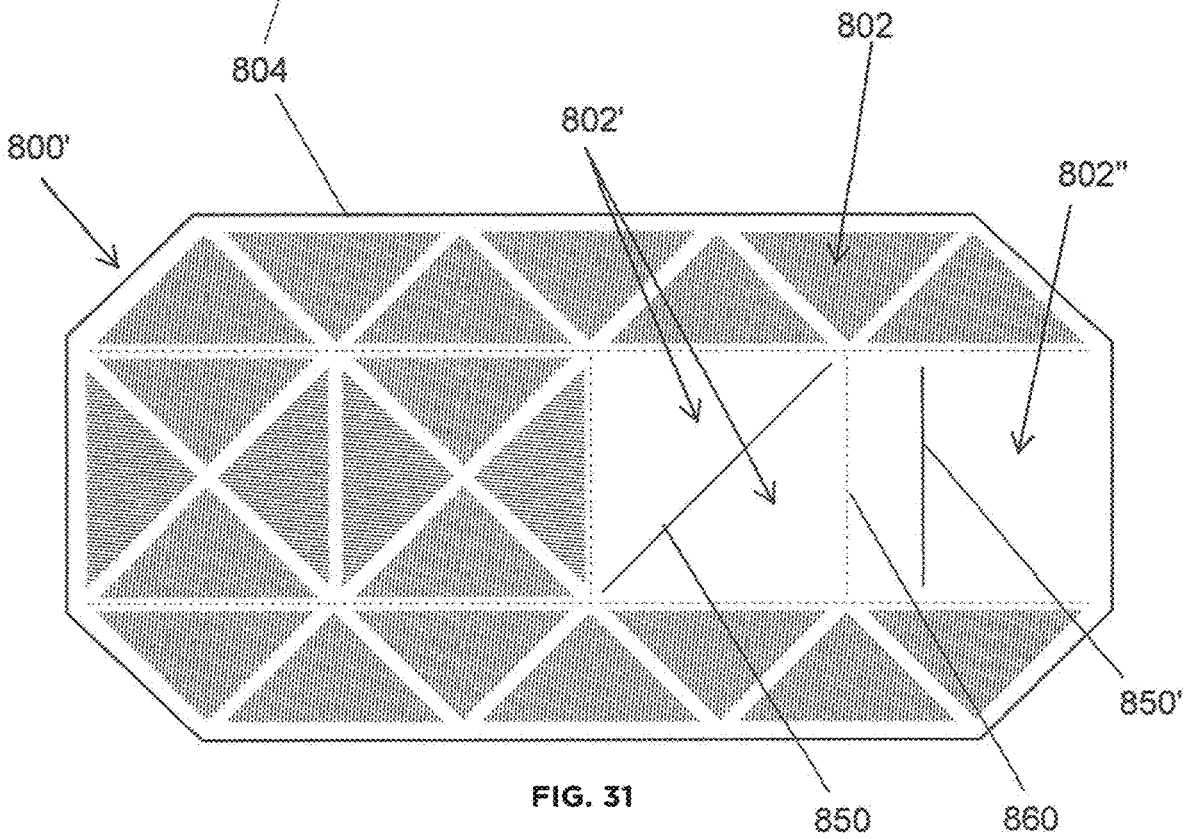
FIG. 31 illustrates a planar view of a receptacle in accordance with an embodiment.

It is to be understood that the receptacles and pockets can comprise shapes other than above described triangular, square or rectangular shapes. In an example of FIG. 25, the receptacle 510 can be configured as a single pentagon-shaped pocket with a single access 550. In an example of FIG. 26, the receptacle 520 can be configured as a single hexagon-shaped pocket with a single access 550. In an example, a single-pocket receptacle can be configured as an octagon-shaped receptacle. In an example of FIG. 27, the receptacle 600 can be configured with an octagon-shaped peripheral edge 604 and with a plurality of triangular-shaped pockets 602 by way of second connections 660, each pocket 602 having a single access 650. In an example of FIG. 28, the receptacle 700 can be configured with a hexagon-shaped peripheral edge 704 and with a plurality of triangular shaped pockets 702. In an example of FIG. 29, the receptacle 700' can be also configured with a hexagon shaped peripheral edge 704 and with a plurality of triangular shaped pockets 702 that are configured differently than the pockets 702 of FIG. 28. FIG. 30 illustrates an example of the receptacle 800 that has an octagonally-shaped peripheral edge 804 and a plurality of triangular-shaped pockets 802. FIG. 31 also illustrates an example of the receptacle 800 that has an octagonally-shaped peripheral edge 804 and a plurality of triangular-shaped pockets 802, 802' of different sizes. FIG. 31 also illustrates that the receptacle 800' can also comprise square-shaped pockets 800", with an access opening 850, 850', where all pockets defined by second connections 860.

It is to be understood that the receptacles and pockets can be provided in different shapes. In an example, pentagon-shaped, hexagon-shaped or octagon-shaped pocket can comprise one or more elongated openings. Thus, the connections between such pentagon-shaped, hexagon-shaped and octagon-shaped pockets can be in a pattern other than the above described orthogonal pattern of second connections 260, 460. Likewise, the elongated (access) openings can be disposed in a pattern being other than the above described orthogonal grid of openings 250 or 450. The receptacle can also comprise pockets of different sizes and shapes. It is to be understood that pockets of different shapes can be either detachably or permanently attached therebetween. In an example, any combination of five triangular-shaped pockets 10 and square-shaped receptacles 100 can be attached to a single pentagon-shaped receptacle 510. In an example, any combination of six triangular-shaped pockets 10 and square-shaped receptacles 100 can be attached to a single hexagon-shaped receptacle 520.

It will be understood that when the filler material 2 comprises plastic shopping bags, such plastic shopping bags can be folded into a shape representative of the shape of the respective pocket prior to insertion thereinto. It is not necessary for the plastic shopping bags to be folded into the shape that is of an identical size to a size of the respective pocket and some clearance between a peripheral inner edge of each pocket and a peripheral edge of each folded plastic shopping bag is contemplated herewithin. Even if the size of the folded plastic shopping bag is larger than the size of the respective pocket, the folded plastic shopping bag can be either left as is after insertion or the size of such folded shopping bags can be adjusted after insertion to eliminate a greater than desirable swelling (expansion) of the respective pocket.

Folding the plastic bag prior to insertion allows to maximize a volume of any of the described pocket. Folding also helps with the organization of the bags and allows a user to account for and know precisely how many plastic bags have been inserted into the receptacle. Additionally, folding allows for consistency in regard to having an even amount of protection (surrounding whatever is being protected) via the cushioning capability. As well as, folding provides for a neat/clean/sleek overall product. However, it is to be understood that some pockets within a multi-pocket receptacle can be left unfilled. As well, as some pockets within a multi-pocket receptacle can receive a different number of the plastic bags.

When considering an effort of cleaning-up the environment by turning plastic grocery bags into a cushioning system, it becomes clear that there are many opportunities to get people involved into this effort. With necessary steps being collecting, washing, folding and stuffing/packaging the plastic grocery bags, there is a great potential for creating new job opportunities for a number of people. There could be teams of collectors (grocery store pick-ups, at home pick-ups, teams walking around and picking up plastic grocery bags from the ground), teams/systems to then wash the bags as well as dry the bags. Teams can be formed to focus on folding the bags as well as teams can be formed to stuff (insert) the bags into the receptacle.

When unused plastic shopping bags are deemed as no longer being fit for use, such unused plastic shopping bags can be also used with any of the above described receptacles, rather than facing challenges associated with recycling process. Likewise, unused garbage plastic bags and utility plastics bags can be also reused rather than being recycled. Thus, any of the above described receptacles and methods can be directed to any one of reusing plastic bags, converting plastic bags into a functioning article, converting plastic bags into a cushioning article, converting plastic bags into a storage article and the like functions.

Having unfortunate proliferation of homeless population, such homeless population can be tasked with collecting and processing the used grocery bags and further to convert them into a functional bedding component to sleep on. In other words, the receptacle or receptacle system of any of the above described embodiment with the filler material 2 can be configured as a mattress pad, suitable to be slept on. A portion of such bedding article where the person will lay his/her head on can be provided with a greater thickness, by way of a greater number of inserted plastics bags, so as to define a pillow portion. Or, the user can fold several sections of the receptacle at the second connections or roll up several sections of the receptacle to form a pillow portion. Another receptacle with the filler material can be used as a blanket.

The receptacle, for example such as above described receptacle 200, with the filler 2 can be also used as a protection when transporting larger objects, for example such as a desk, a dresser, a refrigerator, a TV and the like objects, inside of moving vans or trucks instead of conventional shipping blankets or pads.

In any of the above describe embodiments, the elongated opening through a thickness of the wall can also be directed to an opening formed by adjacent edges of two different pocket portions joined therebetween.

If the provisions of 35 USC § 112(6) are desired to be invoked in any apparatus claim associated herewith, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(6) are not intended to be invoked for that claim.

What is claimed is:

1. A multi-purpose cushioning system, comprising:

a receptacle including a first wall having a quadrilateral shape and a second wall having the quadrilateral shape;

a first connection between a peripheral edge of the first wall and a peripheral edges of the second wall, the first connection defining a peripheral edge of the receptacle;

a plurality of second connections between the first wall and the second wall, the plurality of second connections defining a plurality of pockets within the peripheral edge of the receptacle, wherein the plurality of pockets are filled with cushioning material comprising plastic shopping bags, each pocket of the plurality is square-shaped and includes an elongated opening through a thickness of one of the first wall and the second wall so as to expose a hollow interior of the pocket to an external environment, the elongated opening having a length which is aligned with a pair of diagonally opposite corners of the pocket and thereby divides the pocket into a pair of triangular portions, and each plastic shopping bag is folded into a triangular shape prior to insertion into a respective triangular portion, said triangular shape being substantially equal to the shape of a respective triangular portion;

where the receptacle is configured to bend along the plurality of second connections.

2. The multi-purpose cushioning system of claim 1, further comprising a first fastener attached to one portion of the peripheral edge of the receptacle and a second fastener attached to an opposite portion of the peripheral edge of the receptacle.

3. The multi-purpose cushioning system of claim 1, wherein at least one of the first and second walls comprises a material selected from the group consisting of nylon, canvas, natural leather, synthetic leather, and neoprene.

4. The multi-purpose cushioning system of claim 1, wherein at least one of the first and second walls comprises a material selected from a mildew resistant material, waterproof material, and a combination thereof.

5. The multi-purpose cushioning system of claim 1, wherein at least one of the first and second walls comprises a mildew resistant coating or a waterproof coating.

* * * * *